US007784525B1

(12) United States Patent
Dai

(10) Patent No.: US 7,784,525 B1
(45) Date of Patent: Aug. 31, 2010

(54) ECONOMICAL METHODS AND INJECTION APPARATUS FOR HIGH PRESSURE DIE CASTING PROCESS

(76) Inventor: Zhongnan Dai, 1166 Candlenut Ln, Palatine, IL (US) 60074

( * ) Notice: Subject to any disclaimer, the term of this patent is extended or adjusted under 35 U.S.C. 154(b) by 441 days.

(21) Appl. No.: 11/923,518

(22) Filed: Oct. 24, 2007

Related U.S. Application Data

(60) Provisional application No. 60/930,859, filed on May 19, 2007.

(51) Int. Cl.
*B22D 17/08* (2006.01)
*B22D 18/02* (2006.01)
*B22D 27/11* (2006.01)

(52) U.S. Cl. ..... 164/120; 164/312; 164/313

(58) Field of Classification Search ..... 164/113, 164/120, 312–315
See application file for complete search history.

(56) References Cited

U.S. PATENT DOCUMENTS 4,240,497 A 12/1980 Glazunov
4,499,941 A * 2/1985 Goldhamer ..... 164/313
4,860,818 A * 8/1989 Dannoura ..... 164/314
4,955,424 A 9/1990 Takehisa
5,718,280 A 2/1998 Matsuura
5,842,509 A 12/1998 Nagashima
6,352,099 B1 3/2002 Koya
6,997,231 B1 2/2006 Jung
7,004,224 B2 2/2006 Tsuzuki
7,017,649 B2 3/2006 Kubota
7,048,535 B2 5/2006 Takanohashi
7,210,517 B2 5/2007 Kubota

FOREIGN PATENT DOCUMENTS

JP 61-30274 * 2/1986

* cited by examiner

*Primary Examiner*—Kuang Lin

(57) ABSTRACT

A method of and an apparatus for high pressure die casting are disclosed. The method uses a die casting apparatus which comprises a group of three plungers for casting metal. The two of which, injection plunger 1 and assistant plunger 3, are used to reduce metal loading time and reduce entrapped gases in die casting during a fast injection stage. By moving into injection sleeve 2, the assistant plunger separates the mold cavity 11 from the space defined by assistant plunger 3, injection sleeve 2, and injection plunger 1. The flow power device for moving said assistant plunger 3 is mounded on a back plate 8. A third plunger, the intensification plunger 12, is used to squeeze casting as soon as the injection plunger advances to a position in which the runner is separated from the closed space. This separated injection and intensification systems eliminates slow shot speed and fast shot deceleration stages and can use a position-limiting switch to start intensification which eliminates the need for a complex hydraulic valve system.

6 Claims, 3 Drawing Sheets

ECONOMICAL METHODS AND INJECTION APPARATUS FOR HIGH PRESSURE DIE CASTING PROCESS

CROSS-REFERENCE TO RELATED APPLICATIONS

This application claims the benefit of provisional patent application Ser. No. 60/930,859, filed on May 19, 2007.

FEDERALLY SPONSORED RESEARCH

Not Applicable

SEQUENCE LISTING OR PROGRAM

Not Application

BACKGROUND

1. Field of Invention

This invention relates to economical methods and apparatuses for manufacturing a high-pressure die casting.

2. Prior Art

In a conventional die-casting method, a mold or die typically includes at least two mating parts that can be separated to facilitate removal of the cast part when it has cooled sufficiently. Only when the mold is closed could the molten metal be poured into the sleeve of a die casting machine. The molten metal is then forcibly injected into the mold cavity. For the purpose of simplicity, the mold or die will be described herein with reference to two mating parts or halves. Until the metal is cool enough to be removed, the mold halves must be held together under pressure by a clamping force. The clamping force is often extremely high in order to overcome the force exerted by the molten metal as it is driven into the cavity and thereby keep the die halves effectively sealed.

It is known that the quality of the casting improves with more rapid flow of the molten metal into the die cavity. With conventional control systems, however, as the velocity of the flow of the molten metal into the cavity increases, the impact pressure that the metal exerts on the die increases. At some point, that pressure might be sufficiently high to overcome the clamping force, causing the die halves to separate and allow metal to leak from the cavity, thereby destroying the integrity of the cast part. As a result, the pressure within the die cavity must be controlled in the die casting process. On other hand, the more rapid the flow of the molten metal into the die cavity, the more gases can be entrapped in the casting after the completion of the injection.

To reduce the pressure that the metal exerts on the die, a method is shown on U.S. Pat. No. 7,174,947. This method reduces the impact pressure of the molten metal on the mold by appropriately setting the volume of the overflow chambers and the cross-sectional area of the gates of the overflow chambers.

One way to reduce gases in die-casting is with the vacuum die-casting method. However, the internal gas pressure of the cavity has a limited vacuum range from 100 to 500 millibar (see U.S. Pat. No. 6,648,054) even this system equip with an expensive vacuum unit. Therefore, we need a new method to further reduce gases.

The second group of improved die casting methods has proposed for the manufacture of wieldable die-cast products: controlling flow rate at the gate. An example is the Japanese Patent Laid-Open Publication No. HEI-4-172166 entitled "METHOD OF MANUFACTURING ALUMINUM CAST PARTS FOR BRAZING". According to this method, as shown in the drawing figures of the publication, the flow rate of molten metal at a gate (gate velocity) is switched stepwise between a low flow rate ranging from 0.3 msec to 0.6 msec for a first half of processing and a high flow rate ranging from 10 msec to 30 msec for a latter half of the processing.

Koya, et al on U.S. Pat. No. 6,352,099 uses a new method to achieve the above purpose, according to this invention, and provides an aluminum alloy die casting method comprising of the steps of providing a die casting machine having a gate for the passage of molten aluminum alloy, setting a flow rate of the molten aluminum alloy at the gate to be in a range of 5 msec to 15 msec, and press-injecting the molten aluminum alloy into a cavity of a die.

However, for most of the die casting process, if we need to achieve good surface finishing, the typical flow rate of molten metal at a gate is 30 msec for Al, 45 m/s for Zn, and 65-90 msec for Mg (Walkgton, William. *Surface Defects: Guide to Correcting the Problem.* 517. Rosemont, Ill.: North American Die Casting Association, 2005.). Therefore a better method is needed to keep a higher flow rate and reduce entrapped gases.

The third method shown is on U.S. Pat. No. 5,718,280, which uses special units to inhibit a molten metal from involving gases contained in a plunger sleeve. However, the die casting apparatus disclosed in the publication has a complicated construction, because it requires a plunger chip movably disposed into a plunger sleeve and an electromagnetic induction coil disposed around the plunger sleeve. These two addition units will also cause more maintenance work during liquid metal is poured outside the pour hole.

SUMMARY

The purposes of present invention are:

1) To reduce entrapped gases in die casting during a fast injection stage.

2) To eliminate molten metal pouring time by loading metal into the sleeve before the mold closes.

3) To eliminate electronic/hydraulic control circles for low impact and transition of slow injection and fast injection.

Disclosed are economical methods and apparatuses for high-pressure die-casting. The method of the invention uses three plungers (pistons), of which one is mounted on a fixed back plate. This unit reduces metal loading time, entrapped gases during fast injection, impact force on a movable mold from fast injection.

Other methods of the invention use two other plungers (pistons), of which one is used as a pour hole close injection and to begin the fast-injection process by which molten metal is forced into the mold cavity. The second is used as a high-pressure intensifier plunger on the molten metal to produce near-net shape finished cast parts with low porosity. The separated slow/fast injection processes and intensification system can use a simplified unit such as a position limit switch to start intensification, which eliminates the need for a complex hydraulic control system.

The present invention has been developed in view of the aforementioned circumstances. It, therefore, has the objective of reducing entrapped gases and high impart in die casting during a fast injection stage in a swift and economical fashion.

These objects will become clearer from the following drawings.

Five drawings have been included:

REFERENCE NUMERALS IN DRAWINGS

Figure 1:
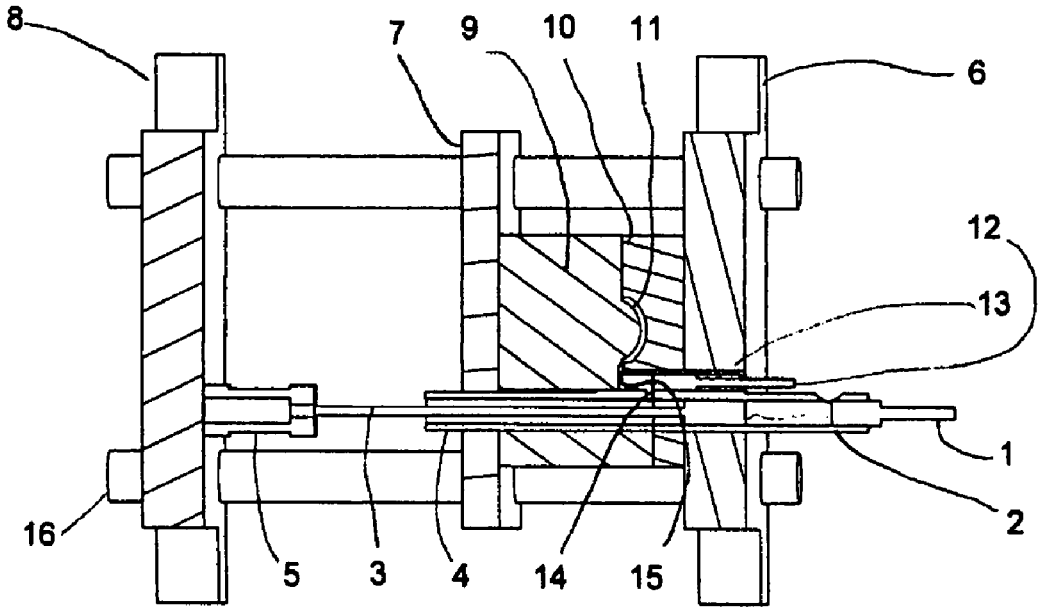
FIG. 1 is a view of injection system before the start of the injection.

1 injection plunger, 2 injection sleeve, 3 assistant plunger, 4 assistant sleeve 5 hydraulic cylinder, 6 stationary plate, 7 movable plate, 8 back plate, 9 movable mold 10 stationary mold, 11 cavity, 12 intensification plunger, 13 intensification sleeve 14 runner, 15 gate, 16 tie bar As shown in FIG. 1:

The die casting apparatus includes a stationary plate 6, a stationary mold 10, a movable plate 7, and a movable mold 9. Stationary mold 10 is fixed to Stationary plate 6. Movable mold 9 is fixed to movable plate 7, which is advances to and retracts from stationary mold 10 to open and close the entire mold. When the entire mold is closed, a cavity 11 is formed between stationary mold 10 and movable mold 9.

Stationary plate 6 and stationary mold 10 are provided with two plunger-sleeve-receiving holes into which injection sleeve 2 and an intensification sleeve 13 are fitted. The inner space of injection sleeve 2 is connected to the inner space of intensification sleeve 13 and cavity 11 by the way of a runner 14 and a gate 15.

Movable plate 7 and movable mold 9 are provided with a plunger-sleeve-receiving hole into which an assistant sleeve 4 is fitted.

Injection plunger 1, assistant plunger 3, and intensification plunger12 are advanced and retracted by actuating hydraulic cylinders.

The invention thus has as its objective the development of a process for die casting which avoids entrapped gas through a simpler and more reliable process control and allows improved casting quality and an increase of efficiency.

Figure 2:
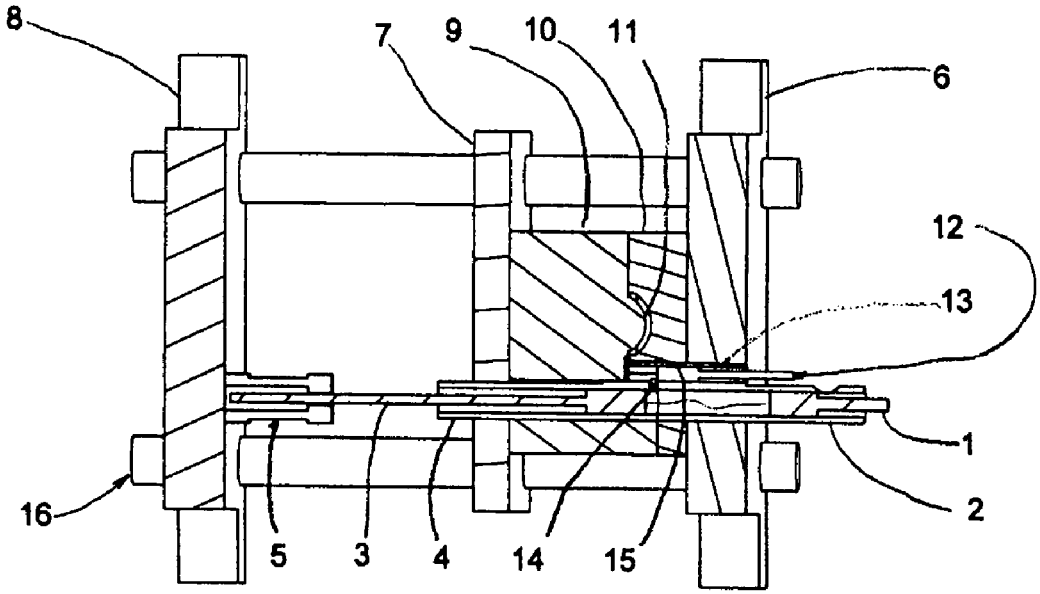
FIG. 2 is a view of injection system at end of metal filling.
Figure 3:
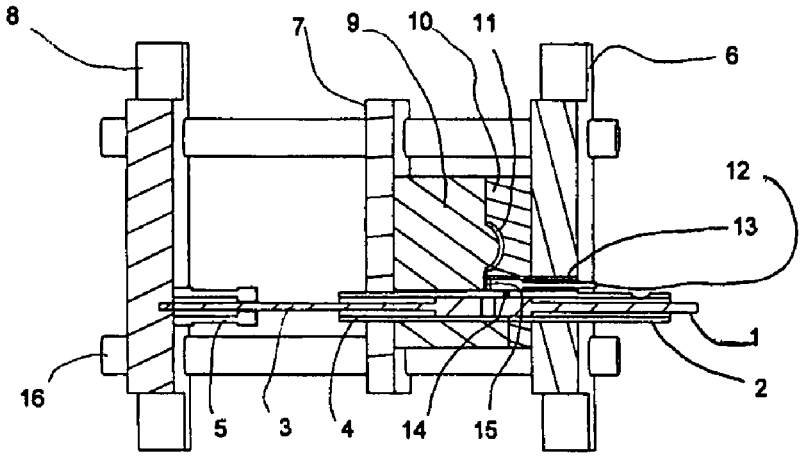
FIG. 3 is view of injection system at the intensification stage.

How the presented method achieves its results (see FIG. 1 through FIG. 3):

At the beginning of casting circle, assistant plunger 3 moves forward into injection sleeve 2, which forms a blocked space with injection sleeve 2 and injection plunger 1. When the operator or auto spray unit sprays movable mold 9 and stationary mold 10, the molten metal can be poured into the space formed by assistant plunger 3, injection sleeve 2, and injection plunger 1. Therefore this method eliminates metal pouring time. See FIG. 1

After movable mold 9 and stationary mold 10 close, injection plunger 1 passes the pour hole then starts a fast injection immediately. Because of assistant plunger 3, which separates air and metal, the entrapped gas will be reduced greatly. Since the presented invention eliminates the slow injection, it also eliminates the hydraulic circle necessary for starting a slow injection. See FIG. 2

At end of injection process, injection plunger 1 enters assistant plunger sleeve 4 and the impact force of assistant plunger 3 acts on back plate 8. Hence, there is no impact pressure acting on the movable mold 9. In this way, the presented invention eliminates metal flash from cavity 11. Therefore, there is no need for a low impact function and the hydraulic circle for low impact on the presented invention. See FIG. 3.

When injection plunger 1 closes runner 14, intensification plunger 12 moves forward to squeeze the molten metal; this function could be triggered by a timer, pressure sensor, or position limit switch.

Figure 4:
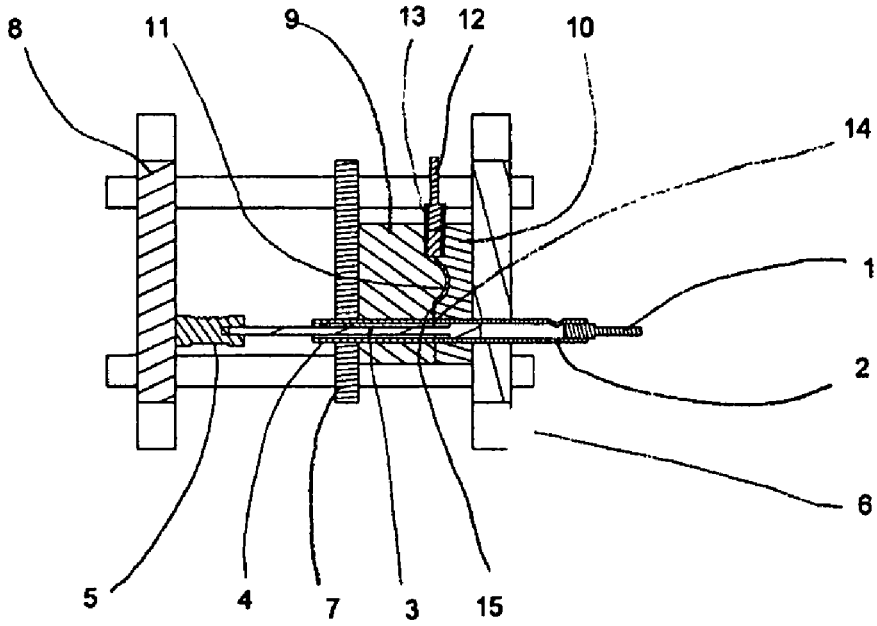
FIG. 4 illustrates an alternative embodiment of the presented invention.
Figure 5:
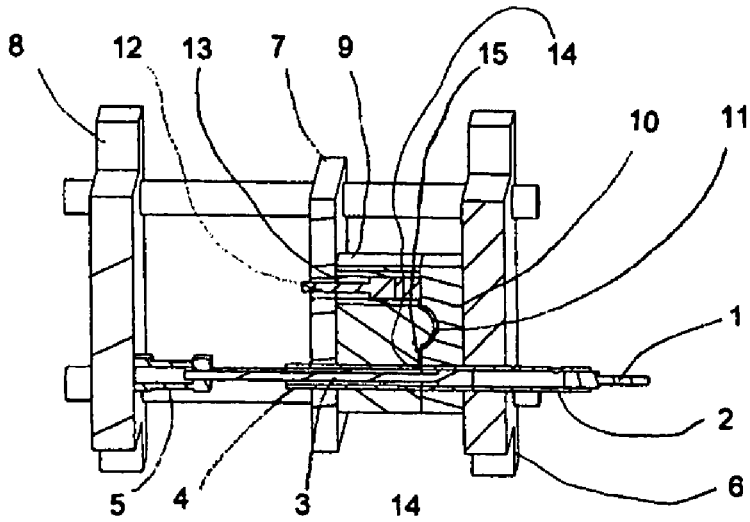
FIG. 5 illustrates the second embodiment of the presented invention.

The presented invention has alternative methods as described below:

The position intensification plunger 12 and intensification sleeve 13 could be moved to another cavity location or they can be move to movable plate as in FIG. 4 and FIG. 5.

The assistant plunger mechanism could be telescoped within a hydraulic cylinder.

Summarizing the effects of the invention, it is possible to obtain a suitable reduced casting circle time, squeeze molten metal and prevent the entry of the gas into metal during fast injection. Therefore it improve casting quality, reduce circle time with a simplified control system.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A die casting machine for the production of casting parts from metals, and/or their alloys, comprising of: a horizontal injection plunger (1); a horizontal assistant plunger (3) positioned to face the horizontal injection plunger; an injection sleeve (2) which cooperates with the horizontal injection plunger and horizontal assistant plunger to define a closed space in which the liquid metal is loaded into; a movable mold (9) and a stationary mold (10); a cavity formed between the movable mold and the stationary mold; the injection plunger is operable to seal the cavity from the closed spaced; an intensification plunger(12) which squeezes the liquid after the injection plunger seals the cavity from the closed space (11); a mold support on which the stationary mold (10) and the movable mold (9) are mounted, wherein said injection plunger, said assistant plunger and said intensification plunger are moved by a respective flow power device such as a hydraulic cylinder or a servo motor, and wherein the flow power device for moving said assistant plunger is mounded on a back plate (8), whereby it will cause no impact pressure to movable plate (7) at the end of the cavity filling of molten metal.

2. The die casting machine according to claim 1, wherein, said horizontal injection plunger and said horizontal assistant plunger move along the same horizontal axis.

3. The die casting machine according to claim 1, wherein, said closed space separates the die cavity by said assistant plunger when the injection phase begins.

4. The die casting machine according to claim 1, wherein, said intensification plunger, which can be mounted on the stationary plate, mold, or the movable plate, is activated with higher pressure than the horizontal injection plunger.

5. A die casting method, comprising the steps of: mounting a flow power device for moving an assistant plunger on a back plate advancing the assistant plunger to form a closed space with an injection sleeve and an injection plunger; moving a ladle to load metal into the closed space; advancing a ram of a horizontal injection plunger to force metal into a die cavity; separating the closed space from the cavity by the injection plunger; then move an intensification plunger to squeeze the metal at the end of cavity filling, whereby it eliminates the slow shot speed stage, fast shot deceleration stage, and reduce entrapped gases in the fast shot phase of high pressure die casting process.

6. The method according to claim 5, is further comprised of loading molten metal into die casting machine when the mold cavity is open.

* * * * *